US011682246B2

(12) United States Patent
Park et al.

(10) Patent No.: US 11,682,246 B2
(45) Date of Patent: Jun. 20, 2023

(54) SYSTEM AND METHOD FOR TRACKING VEHICLE ACTIVITY AND REPORTING VEHICLE ISSUES

(71) Applicant: AVL POWERTRAIN ENGINEERING, INC., Plymouth, MI (US)

(72) Inventors: Talus Park, Dexter, MI (US); Paul Bromnick, Northville, MI (US); Martin Steinbacher, Graz (AT); Xinwei Hu, Shoreline, WA (US)

(73) Assignee: AVL POWERTRAIN ENGINEERING, INC., Plymouth, MI (US)

( * ) Notice: Subject to any disclaimer, the term of this patent is extended or adjusted under 35 U.S.C. 154(b) by 375 days.

(21) Appl. No.: 17/063,234

(22) Filed: Oct. 5, 2020

(65) Prior Publication Data

US 2021/0019962 A1 Jan. 21, 2021

Related U.S. Application Data

(63) Continuation of application No. 15/972,298, filed on May 7, 2018, now Pat. No. 10,810,809.

(60) Provisional application No. 62/504,191, filed on May 10, 2017.

(51) Int. Cl.
*G07C 5/08* (2006.01)
*G07C 5/00* (2006.01)

(52) U.S. Cl.
CPC ..... *G07C 5/0825* (2013.01); *G07C 5/008* (2013.01); *G07C 5/0808* (2013.01); *G07C 5/085* (2013.01)

(58) Field of Classification Search
CPC .... G07C 5/008; G07C 5/0808; G07C 5/0825; G07C 5/085
See application file for complete search history.

(56) References Cited

U.S. PATENT DOCUMENTS

| | | | |
|---|---|---|---|
| 2003/0216889 | A1 | 11/2003 | Marko et al. |
| 2013/0302758 | A1 | 11/2013 | Wright |
| 2014/0052531 | A1 | 2/2014 | Kent et al. |
| 2014/0226010 | A1 | 8/2014 | Molln et al. |
| 2015/0312655 | A1 | 10/2015 | Balakrishnan et al. |
| 2016/0163133 | A1 | 6/2016 | Ricci |
| 2016/0196698 | A1 | 7/2016 | O'Dell et al. |
| 2017/0113664 | A1 | 4/2017 | Nix |
| 2017/0212526 | A1 | 7/2017 | Vanderpool et al. |
| 2018/0174373 | A1 | 6/2018 | Hansen et al. |
| 2020/0005563 | A1 | 1/2020 | Zaccherini et al. |

OTHER PUBLICATIONS

USPTO, Non-Final Office Action for U.S. Appl. No. 15/972,298, dated Jan. 29, 2020.

*Primary Examiner* — Anshul Sood
(74) *Attorney, Agent, or Firm* — Honigman LLP; Matthew H. Szalach

(57) ABSTRACT

A system according to the present disclosure includes an identification module, a data recording module, and a data upload module. The identification module is configured to identify at least one of a vehicle and a user of the vehicle. The data recording module is configured to record a location of the vehicle, an acceleration of the vehicle, and data received from a controller area network (CAN) bus of the vehicle during a driving session. The data upload module is configured to upload the vehicle location, the vehicle acceleration, the CAN bus data, and at least one of the vehicle identification and the user identification to a remote server.

20 Claims, 2 Drawing Sheets

SYSTEM AND METHOD FOR TRACKING VEHICLE ACTIVITY AND REPORTING VEHICLE ISSUES

CROSS-REFERENCE TO RELATED APPLICATIONS

This application is a continuation of U.S. application Ser. No. 15/972,298, filed on May 7, 2018 which claims the benefit of U.S. Provisional Application No. 62/504,191, filed on May 10, 2017. The entire disclosures of the applications referenced above are incorporated herein by reference.

FIELD

The present disclosure relates to systems and methods for tracking vehicle activity, including tracking engineering activity being conducted in a vehicle, and reporting vehicle issues.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

During vehicle development, calibration and development engineers drive a development vehicle to evaluate the vehicle. The calibration engineers adjust software parameters of the vehicle based on the evaluation, and the development engineers adjust hardware designs of the vehicle based on the evaluation. Vehicle manufacturers have made efforts to reduce development costs by reducing the number of hours that calibration and development engineers spend driving and evaluating vehicles so that the number of development vehicles needed for each new vehicle platform may be reduced. However, there is currently no way to assess vehicle development efficiency, as there is no reliable method for determining how many hours a development vehicle is driven or the type of calibration or development activity for which the vehicle is driven. Instead, vehicle manufacturers rely on calibration and development engineers to record the number of hours driven and the corresponding vehicle activity using paper logs.

In addition, development vehicles are often driven by managers, executives, and other "voice of the customer" employees for the purpose of communicating issues to the development and calibration engineers. If the "voice of the customer" employees observe an issue during a driving session, the employees describe the issues to the development and calibration engineers using email, paper notes, or verbal communication. As a result, the development and calibration engineers may struggle to replicate the issue in a development vehicle, and the issue may not be resolved.

SUMMARY

A system according to the present disclosure includes an identification module, a data recording module, and a data upload module. The identification module is configured to identify at least one of a vehicle and a user of the vehicle. The data recording module is configured to record a location of the vehicle, an acceleration of the vehicle, and data received from a controller area network (CAN) bus of the vehicle during a driving session. The data upload module is configured to upload the vehicle location, the vehicle acceleration, the CAN bus data, and at least one of the vehicle identification and the user identification to a remote server.

In one aspect, the system further includes a user interface device (UID) control module configured to control a user interface device to display a list of vehicle activities and to prompt the user to select one of the vehicle activities, and the data upload module is configured to upload the selected vehicle activity to the remote server.

In one aspect, the data recording module is configured to select data channels of the CAN bus based on the selected vehicle activity and record the selected data channels.

In one aspect, the system further includes a user interface device (UID) control module is configured to control a user interface device to display a list of data channels available on the CAN bus and to prompt the user to select one of the data channels, and the data recording module is configured to record the selected data channels.

In one aspect, the system further includes a wireless communication module configured to store a code, the identification module is configured to identify the vehicle based on the code, and the data upload module is configured to upload the vehicle identification to the remote server. The wireless communication module is one of included in the vehicle and included in a wireless connector that is inserted into a communication port of the vehicle.

In one aspect, the identification module is configured to identify the vehicle based on an input received from a barcode reader operable to read a barcode mounted in the vehicle, and the data upload module is configured to upload the vehicle identification to the remote server.

In one aspect, the identification module is configured to identify the user based on an input received from at least one of microchip implanted in the user and a mobile device within a communication range of the vehicle, and the data upload module is configured to upload the user identification to the remote server.

In one aspect, the data upload module is configured to upload a date and a time associated with at least one of the vehicle location, the vehicle acceleration, and the CAN bus data to the remote server.

In one aspect, the system further includes a user interface device (UID) control module configured to control a user interface device to prompt the user to enter comments describing the driving session, and the data upload module is configured to upload the comments to the remote server.

In one aspect, the data upload module is configured to upload all of the vehicle location, the vehicle acceleration, the CAN bus data recorded during the driving session when the user indicates that a vehicle issue has occurred.

In one aspect, the data upload module is configured to upload the vehicle location, the vehicle acceleration, the CAN bus data recorded during a first period before the user indicates that the vehicle issue occurred and during a second period after the user indicates that the vehicle issue occurred.

In one aspect, the data recording module is configured to record a weather condition during the driving session based on the vehicle location and an input received from an online source, and the data upload module is configured to upload the weather condition to the remote server.

In one aspect, the system further includes a user interface device (UID) control module configured to control a user interface device to display a list of vehicle issues and to prompt the user to select one of the vehicle issues. The data upload module is configured to upload the selected vehicle issue to the remote server.

In one aspect, the data upload module is configured to select a person from a plurality of people based on the selected vehicle issue, and the data upload module is configured to notify the selected person that data related to the selected vehicle issue is uploaded to the remote server.

In one aspect, the system further includes an accelerometer configured to measure the vehicle acceleration, and a global positioning system (GPS) module configured to determine the vehicle location based on a signal received from a GPS satellite.

A method according to the present disclosure includes identifying at least one of a vehicle and a user of the vehicle, and recording a location of the vehicle, an acceleration of the vehicle, and data received from a controller area network (CAN) bus of the vehicle during a driving session. The method further includes uploading the vehicle location, the vehicle acceleration, the CAN bus data, and at least one of the vehicle identification and the user identification to a remote server.

In one aspect, the method further includes controlling a user interface device to display a list of vehicle activities and to prompt the user to select one of the vehicle activities and uploading the selected vehicle activity to the remote server.

In one aspect, the method further includes selecting data channels of the CAN bus based on the selected vehicle activity, and recording the selected data channels.

In one aspect, the method further includes controlling a user interface device to display a list of data channels available on the CAN bus and to prompt the user to select one of the data channels, and recording the selected data channels.

In one aspect, the method further includes storing a code in a wireless communication module, identifying the vehicle based on the code, and uploading the vehicle identification to the remote server. The wireless communication module is one of included in the vehicle and included in a wireless connector that is inserted into a communication port of the vehicle.

In one aspect, the method further includes identifying the vehicle based on an input received from a barcode reader operable to read a barcode mounted in the vehicle, and uploading the vehicle identification to the remote server.

In one aspect, the method further includes identifying the user based on an input received from at least one of microchip implanted in the user and a mobile device within a communication range of the vehicle, and uploading the user identification to the remote server.

In one aspect, the method further includes uploading a date and a time associated with at least one of the vehicle location, the vehicle acceleration, and the CAN bus data to the remote server.

In one aspect, the method further includes controlling a user interface device to prompt the user to enter comments describing the driving session, and uploading the comments to the remote server.

In one aspect, the method further includes uploading all of the vehicle location, the vehicle acceleration, the CAN bus data recorded during the driving session when the user indicates that a vehicle issue has occurred.

In one aspect, the method further includes uploading the vehicle location, the vehicle acceleration, the CAN bus data recorded during a first period before the user indicates that the vehicle issue occurred and during a second period after the user indicates that the vehicle issue occurred.

In one aspect, the method further includes recording a weather condition during the driving session based on the vehicle location and an input received from an online source and uploading the weather condition to the remote server.

In one aspect, the method further includes controlling a user interface device to display a list of vehicle issues and to prompt the user to select one of the vehicle issues, and uploading the selected vehicle issue to the remote server.

In one aspect, the method further includes selecting a person from a plurality of people based on the selected vehicle issue, and notifying the selected person that data related to the selected vehicle issue is uploaded to the remote server.

In one aspect, the method further includes measuring the vehicle acceleration, and determining the vehicle location based on a signal received from a GPS satellite.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

Figure 1:
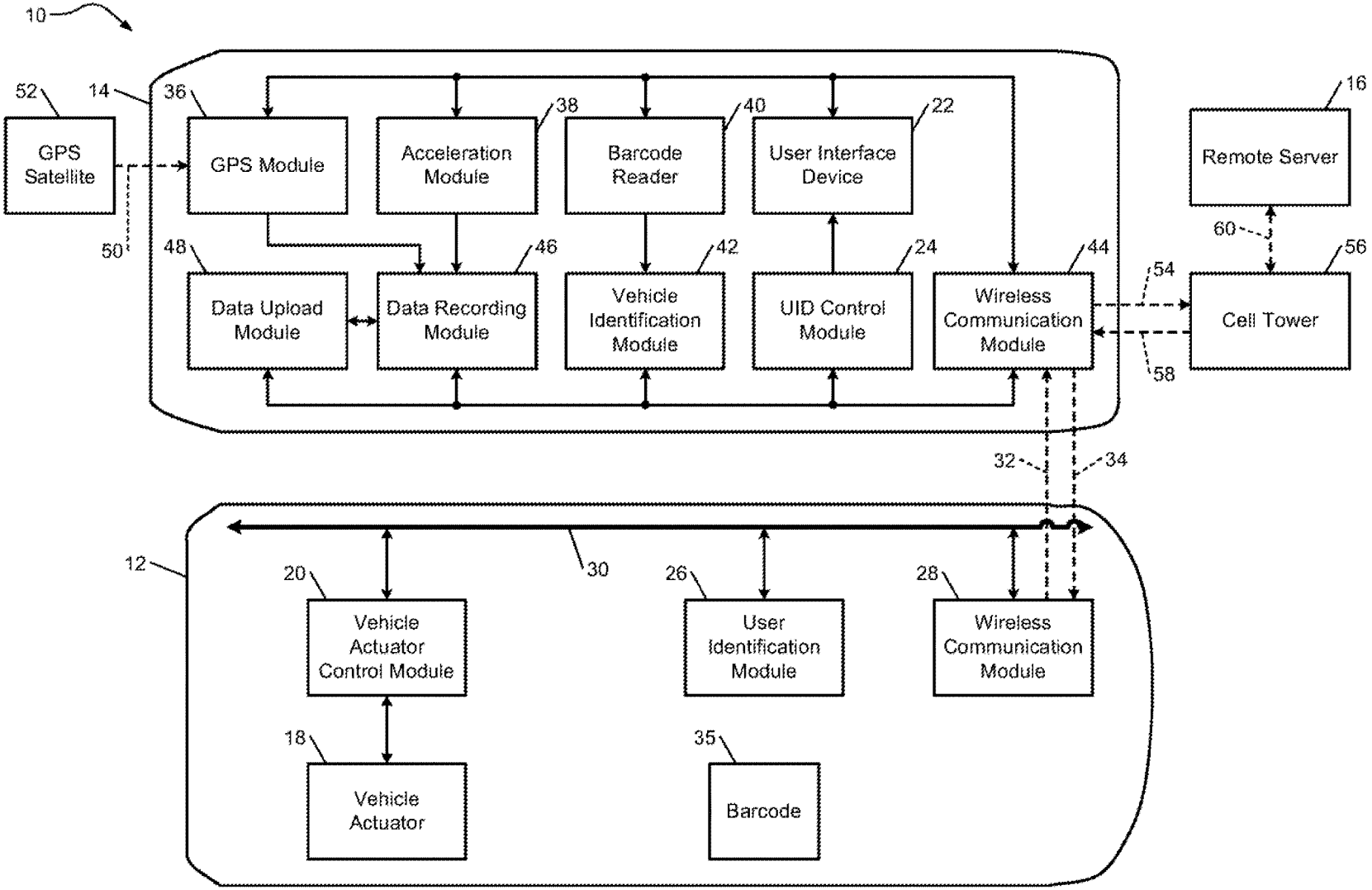
FIG. 1 is a functional block diagram of an example system for tracking vehicle activity and reporting vehicle issues according to the principles of the present disclosure.

A system and method for tracking vehicle activity according to the present disclosure identifies a user of a vehicle, displays a list of vehicle activities based on the user identification, and prompts the user to select one of the vehicle activities. The system and method then records various vehicle operating conditions during a driving session. In one example, the system and method uses an application that is stored on a smartphone that includes an accelerometer and a global positioning system (GPS) module. The user is prompted to log into the application, and the user is identified based on the login information supplied. The smartphone communicates with a controller area network (CAN) bus of the vehicle using a wireless (e.g., Bluetooth) connector that is plugged into an onboard diagnostic (OBD) port of the vehicle.

In addition, during the driving session, the system and method records the vehicle acceleration from the accelerometer, the vehicle location from the GPS module and a corresponding date and time stamp, and one or more data channels available on the CAN bus. The data recorded may be used to determine when, where (e.g., location, altitude, grade), and how the vehicle is driven, and who is driving the vehicle. Further, the data recorded may be used to generate reports that track this information throughout the life of a development vehicle so that a vehicle manufacturer may determine how many vehicle hours are spent on each vehicle activity.

A system and method for reporting vehicle issues according to the present disclosure may also use an application that is stored on a smartphone and a wireless connector that enables the smartphone to communicate with the CAN bus of the vehicle. When the vehicle experiences an issue during a driving session, the user issues a command to take a snapshot by selecting an option on a touchscreen of the smartphone or by issuing a verbal command. In response, the system and method may take a snapshot of the vehicle acceleration, the vehicle location, and the CAN bus data recorded before and after the user reported the issue. The CAN bus data recorded may include engine speed, vehicle speed, and/or transmission gear. In addition, the system and method may prompt the user to enter verbal or written comments regarding the vehicle issue. Further, the system and method may record weather conditions at the time when the vehicle issue occurred based on information provided from an online source (e.g., National Oceanic and Atmospheric Administration).

At the end of the driving session and/or when the user initiates a data upload, the system and method uploads all of the snapshots taken during the driving session to a remote (e.g., cloud) server. The remote server may be accessible to the vehicle development and calibration engineers. Thus, the development and calibration engineers may review the comments regarding vehicle issues experienced by various users and the corresponding vehicle acceleration, vehicle location, and CAN bus data. In turn, the development and calibration engineers may use the vehicle acceleration, vehicle location, and CAN bus data to reproduce the vehicle issue and to root cause the underlying problem that caused the vehicle issue.

Referring now to FIG. 1, an example system 10 for tracking vehicle activity and reporting vehicle issues includes a vehicle 12, a mobile device 14 (e.g., a smartphone, a tablet, a laptop), and a remote (e.g., cloud) server 16. The vehicle 12 includes a vehicle actuator 18, a vehicle actuator control module 20, a user identification module 26, a wireless communication module 28, and a controller area network (CAN) bus 30. The vehicle actuator 18 may include an engine, an electric motor, a transmission, a brake, a steering actuator, an active suspension, and/or an active exhaust. Additionally or alternatively, the vehicle actuator 18 may include one or more components of one or more of the aforementioned subsystems. For example, the vehicle actuator 18 may include one or more components of the engine such as a throttle valve, a fuel injector, a spark plug, and an exhaust valve, and/or an intake valve.

The vehicle actuator control module 20 controls the vehicle actuator 18 based on user input and/or one or more operating conditions of the vehicle 12. In one example, the vehicle actuator control module 20 controls the amount of torque produced by the engine based on a desired vehicle acceleration. The vehicle actuator control module 20 may determine the desired vehicle acceleration based on an accelerator pedal position and/or a difference between a measured vehicle speed and a cruise control set speed.

The user identification module 26 identifies a user (e.g., driver, passenger) of the vehicle 12. The user identification module 26 may identify the user based on an input received from the mobile device 14 and/or a microchip (not shown) implanted in the user. In one example, the mobile device 14 include a user interface device 22 and a user interface device (UID) control module 24 as discussed below, and the user identification module 26 identifies the user based on an input received from the UID control module 24. More specifically, the UID control module 24 controls the user interface device 22 to prompt the user to log into an application, the user interface device 22 relays the login information provided to the user identification module 26, and the user identification module 26 identifies the user based on the login information provided. In another example, the user identification module 26 identifies the user based on a network (e.g., media access control) address of the mobile device 14 and a predetermined relationship between network addresses and users. The user identification module 26 may receive the network address of the mobile device 14, and therefore identify the user, when the mobile device 14 is within a wireless communication range of the wireless communication module 28.

The remote server 16 may track a fleet of vehicles and which users are using each of the vehicles. Once the user identification module 26 identifies a user, the user identification module 26 may send an instruction to the remote server 16 to check out the vehicle 12 to the user identified. If the mobile device 14 is no longer within a wireless communication range of the wireless communication module 28, or if the user identification module 26 identifies another user, the user identification module 26 may send an instruction to the remote server 16 to check in the vehicle 12 and/or check out the vehicle 12 to the new user.

The wireless communication module 28 enables the vehicle actuator control module 20, the UID control module 24, and the user identification module 26 to communicate with the mobile device 14. The wireless communication module 28 may communicate with the vehicle actuator control module 20, and the user identification module 26 via the CAN bus 30. The wireless communication module 28 communicates with the mobile device 14 using a short-range wireless communication protocol (e.g., Bluetooth, Wi-Fi). The wireless communication module 28 is operable to transmit one or more wireless signals 32 to the mobile device 14 and to receive one or more wireless signals 34 from the mobile device 14. The wireless communication module 28 may be included in the vehicle 12, as shown in FIG. 1, or the wireless communication module 28 may be included in a component that is separate from the vehicle 12, such as a wireless (e.g., Bluetooth) connector configured to communicate with the CAN bus 30. The separate component may be plugged into onboard diagnostic (OBD) port (not shown) of the vehicle 12, which may be a universal serial bus (USB) port, or the separate component may be hardwired to the CAN bus 30.

The CAN bus 30 allows the vehicle actuator control module 20, the user identification module 26, and the wireless communication module 28 to communicate with each other without a host computer. In other words, the vehicle actuator control module 20, the user identification module 26, and the wireless communication module 28 communicate with each other through the CAN bus 30. The vehicle 12 may also include one or more sensors (not shown) that communicate with the vehicle actuator control module 20, the user identification module 26, and/or the wireless communication module 28 through the CAN bus 30. The sensors may include an engine speed sensor, a vehicle speed sensor, a transmission gear selector position sensor, an intake air temperature sensor, and/or an engine coolant temperature sensor.

A rigid mounting bracket (not shown) and/or a barcode 35 may be attached to the vehicle 12 using, for example, fasteners and/or adhesive. The mounting bracket may be used to rigidly mount the mobile device 14 in the vehicle 12. The mounting bracket may be attached to an instrument panel (not shown) of the vehicle 12, a center console (not shown) of the vehicle 12, or another component of the vehicle 12 in the vicinity of the driver so that the mobile device 14 is within view of the driver when the mobile device 14 is mounted to the vehicle 12. The mounting bracket may include flexible tabs that spread apart as the mobile device 14 is inserted into the mounting bracket and snap back to their relaxed state to secure the mobile device 14 when the mobile device 14 is fully inserted into the mounting bracket.

The barcode 35 may be used to identify the vehicle 12. The barcode 35 may be attached to the instrument panel of the vehicle 12, the center console of the vehicle 12, or another component of the vehicle 12 in the vicinity of the driver so that the barcode 35 is within view of the driver. The barcode 35 may be a one-dimensional barcode or a two-dimension barcode (e.g., a QR code). The barcode 35 may indicate the year, make, model, and/or vehicle identification number of the vehicle 12. A radio frequency identification (RFID) tag (not shown) that identifies the vehicle 12 may be attached to the vehicle 12 in addition to or instead of the barcode 35.

The mobile device 14 includes the user interface device 22, the UID control module 24, a global positioning system (GPS) module 36, an acceleration module 38, a barcode reader 40, a vehicle identification module 42, a wireless communication module 44, a data recording module 46, and a data upload module 48. The user interface device 22 may include an electronic display (e.g., a touchscreen) that is operable to display text and/or images, and/or to generate messages in response to user input (e.g., a user touching the touchscreen). In addition, the user interface device 22 may include a heads-up display (HUD) that is operable to project text and/or images onto a windshield (not shown) of the vehicle 12. Further, the user interface device 22 may include one or more vibrators mounted to, for example, a steering wheel (not shown) and/or the driver's seat (not shown) to provide haptic feedback to the driver. Moreover, the user interface device 22 may include a speaker that is operable to generate a sound or audible message within the vehicle 12, and/or a microphone that is operable to receive verbal commands from the user.

The UID control module 24 controls the user interface device 22 to communicate with occupants in the vehicle 12. In various implementations, the user interface device 22 and the UID control module 24 may be included in the vehicle 12 instead of the mobile device 14. Alternatively, the vehicle 12 and the mobile device 14 may each include a user interface device and a UID control module that function similar or identical to the user interface device 22 and the UID control module 24, respectively. Alternatively, the vehicle 12 and the mobile device 14 may each include a user interface device that function similar or identical to the user interface device 22, and the UID control module 24 of the mobile device 14 may control both user interface devices.

In addition, a user (e.g., a driver, a passenger) of the vehicle 12 may also use the user interface device 22 to inform the vehicle 12 and/or the mobile device 14 that the vehicle 12 has experienced an issue (e.g., an objectionable event). In one example, the user generates a report vehicle issue command by selecting a "report vehicle issue" option on a touchscreen of the user interface device 22 or by issuing a verbal command. In another example, the UID control module 24 prompts the user to select the type of vehicle issue that occurred from a dropdown menu (or a verbal list), and the user selects one of the vehicle issues listed by touching the touchscreen (or by issuing a voice command). Examples of vehicle issues include hesitations in vehicle acceleration, hard transmission shifts, undesired vehicle noises, and undesired vehicle vibrations.

The GPS module 36 determines the location of the mobile device 14 based on GPS signals 50 received from GPS satellites 52. In addition, when the mobile device 14 is within the vicinity of the vehicle 12, the GPS module 36 determines the location of the vehicle 12 by assuming that the location of the vehicle 12 is the same as the location of the mobile device 14. The GPS module 36 may determine that the mobile device 14 is within the vicinity of the vehicle 12 when the mobile device 14 is within the wireless communication range of the vehicle 12 (e.g., when the mobile device 14 receives the wireless signals 32).

The acceleration module 38 measures the acceleration of the mobile device 14. In addition, when the mobile device 14 is within the vicinity of the vehicle 12, the acceleration module 38 measures the acceleration of the vehicle 12 under the assumption that the acceleration of the vehicle 12 is equal to the acceleration of the mobile device 14. Rigidly mounting the mobile device 14 in the vehicle 12 ensures that this measurement is accurate. The GPS module 36 may determine that the mobile device 14 is within the vicinity of the vehicle 12 when the mobile device 14 is within the wireless communication range of the vehicle 12. The acceleration module 38 may include a single-axis, dual axis, or tri-axis accelerometer that measures the longitudinal (e.g., fore-aft) acceleration of the vehicle 12, the lateral (e.g., side-to-side) acceleration of the vehicle 12, and/or the vertical (e.g., up or down) acceleration of the vehicle 12.

The barcode reader 40 is operable to read (e.g., scan) the barcode 35. In one example, the barcode sensor 40 includes a light that generates a light beam, and a photo sensor that detects the amount of light reflected from the barcode 35. In this example, the barcode sensor 40 may generate a signal indicating the light reflecting pattern of the barcode 35. In another example, the barcode reader 40 includes a camera that generates an image of the barcode 35.

The vehicle identification module 42 identifies the vehicle 12 based on an input received from the wireless communication module 28. In one example, the wireless communication module 28 stores a unique (e.g., alphanumeric) code, and the vehicle identification module 42 identifies the vehicle 12 based on the code and a predetermined relationship between codes and vehicle identifications. The wireless communication module 28 may both store the aforementioned code and be included in a wireless (e.g., Bluetooth) connector that is separate from and (e.g., permanently) affixed to the vehicle 12. The vehicle identification module 42 may receive the code stored in the wireless communication module 28, and therefore identify the vehicle 12, when the mobile device 14 is within the wireless communication range of the vehicle 12.

In addition to or instead of identifying the vehicle 12 based on the code stored in the wireless communication module 28, the vehicle identification module 42 may identify the vehicle 12 based on the light reflecting pattern of the barcode 35 and/or the image of the barcode 35. In one example, the vehicle identification module 42 compares the light reflecting pattern to a plurality of predetermined patterns and identifies the vehicle 12 based on a predetermined relationship between the predetermined patterns and a plurality of vehicles. In another example, the vehicle identification module 42 reads the image of the barcode 35, compares the image of the barcode 35 (or a digital representation thereof) to a plurality of predetermined images (or digital representations thereof), and identifies the vehicle 12 based on a predetermined relationship between the predetermined images and a plurality of vehicles. In various implementations, the barcode reader 40 may be incorporated into the vehicle identification module 42, and/or the mobile device 14 may include a RFID reader (not shown) in addition to or instead of the barcode reader 40. If the vehicle identification module 42 identifies the vehicle 12 independent of the barcode 35 (e.g., based on the code stored in the wireless communication module 28), the barcode 35 and/or the barcode reader 40 may be omitted.

In various implementations, the wireless communication module 28 of the vehicle 12 may be replaced by a pair of wireless communication modules. One of the wireless communication modules may be connected to the CAN bus 30 and may transmit and receive vehicle data to and from the mobile device 14. The other one of the wireless communication modules may not be connected to the CAN bus 30 and/or may be used solely for vehicle identification purposes. For example, this latter wireless communication module may store the unique code that may be used by the vehicle identification module 42 to identify the vehicle 12 and/or may be included in the wireless connector that is separate from and affixed to the vehicle 12.

The wireless communication module 44 enables the user interface device 22, the UID control module 24, the GPS module 36, the acceleration module 38, the barcode reader 40, the vehicle identification module 42, the data recording module 46, and the data upload module 48 to communicate with the vehicle 12. The wireless communication module 44 communicates with the user interface device 22, the UID control module 24, the GPS module 36, the acceleration module 38, the barcode reader 40, the vehicle identification module 42, the data recording module 46, and the data upload module 48 via hardwired connections. The wireless communication module 44 communicates with the vehicle 12 using a short-wavelength wireless communication protocol (e.g., Bluetooth, Wi-Fi). The wireless communication module 44 is operable to transmit the one or more wireless signals 34 to the vehicle 12 and to receive the wireless signals 32 from the vehicle 12. The wireless communication module 44 also communicates with the remote server 16 using a long-range wireless communication protocol (e.g., 3G, 4G). In one example, the wireless communication module 44 communicates with the remote server 16 by transmitting one or more wireless signals 54 to a cell tower 56 and receiving one or more wireless signals 58 from the cell tower 56. The cell tower 56 communicates with the remote server 16 through a wireless and/or hardwired connection 60.

The data recording module 46 records the vehicle location received from the GPS module 36, the vehicle acceleration from the acceleration module 38, and/or one or more data channels available on the CAN bus 30 (e.g., engine speed, vehicle speed, current transmission gear, intake air temperature, engine coolant temperature, engine operational status, fault codes). In addition, the data recording module 46 may receive weather conditions from an online source (e.g., National Oceanic and Atmospheric Administration) through the cell tower 56, and record the weather conditions. The data recording module 46 may record the vehicle location, the vehicle acceleration, the CAN bus data, and/or the weather conditions during each driving session. The data recording module 46 may record the vehicle location at a first rate (e.g., every 10 seconds), record the vehicle acceleration at a second rate (every 5 seconds), and record the CAN bus data at a third rate (e.g., every second). The data recording module 46 may record different data channels of the CAN bus 30 at different rates.

The data recording module 46 may determine which data channels of the CAN bus 30 to record based on a user input. In one example, the UID control module 24 controls the user interface device 22 to display a list of all of the data channels available on the CAN bus 30 and to prompt the user to select which data channel(s) to record, and the data recording module 46 records the selected data channel(s). In another example, the UID control module 24 controls the user interface device 22 to display a list of vehicle activities and prompts the user to select one of the vehicle activities. The data recording module 46 then determines which data channels to record based on the vehicle activity selected and a predetermined relationship between vehicle activities and data channels. Examples of vehicle activities that may be included in the list are engine cold start (e.g., starting an engine when the engine is at an ambient temperature), calibrating a misfire or catalyst ODB monitor, validating a new software release, and transporting the vehicle 12 for repair. The UID control module 24 may determine which vehicle activities to include in the list based on the user identification and/or the vehicle identification. For example, the UID control module 24 may display a first list of vehicle activities for a transmission calibration engineer and a second list of vehicle activities for a suspension development engineer. The second list may include at least one vehicle activity that is not included in the first list and/or vice versa.

The data upload module 48 uploads the vehicle location, the vehicle acceleration, the CAN bus data, the weather conditions, the vehicle identification, and/or the user identification to the remote server 16. The data upload module 48 may upload data once per driving session. For example, the data upload module 48 may upload data when a driving session ends (e.g., when the engine of the vehicle 12 is turned off). Additionally or alternatively, data upload module 48 may upload data when the data recording module 46 is approaching its memory limit so that the data recording module 46 may free additional space for new data by deleting data after it is uploaded. Additionally or alternatively, the data recording module 46 may upload data when the user generates an upload command by, for example, selecting an "upload data" option on a touchscreen of the user interface device 22 or by issuing a verbal command.

The data upload module 48 may determine which data channels of the CAN bus 30 to upload based on whether the user indicates that a vehicle issue occurred during a driving session and/or since the last upload. For example, the data recording module 46 may record all of the data channels available on the CAN bus 30, and the data upload module 48 may upload only a subset of the data channels recorded when the user does not indicate that a vehicle issue occurred. However, when the user indicates that a vehicle issue occurred, the data upload module 48 may upload all of the data channels recorded.

The data upload module 48 may upload all of the data channels recorded during the entire driving session and/or since the last upload when the user indicates that a vehicle issue occurred. Alternatively, the data upload module 48 may upload all of the data channels recorded during a first period before the user indicates that a vehicle issue occurred and during a second period after the user indicates that a vehicle issue occurred. The data upload module 48 may also upload the vehicle location and the vehicle acceleration recorded during the first and second periods. For the remainder of the driving session or the remainder of the period since the last upload, the data upload module 48 may upload the vehicle location, the vehicle acceleration, and/or only a subset of the data channels recorded. The first period has a first predetermined duration, and the second period has a second predetermined duration that is equal to or different than the first predetermined duration.

In various implementations, the GPS module 36, the acceleration module 38, the data recording module 46, and/or the data upload module 48 may be included in the vehicle 12 instead of the mobile device 14. In addition, the wireless communication module 28 may communicate with the remote server 16 in a way similar or identical to the way in which the wireless communication module 44 communicates with the remote server 16. Further, the vehicle identification may be stored in one of the modules included in the vehicle 12. In these implementations, the vehicle 12 may be used to track vehicle activity and report vehicle issues without using the mobile device 14, and therefore the mobile device 14 may be omitted.

Figure 2:
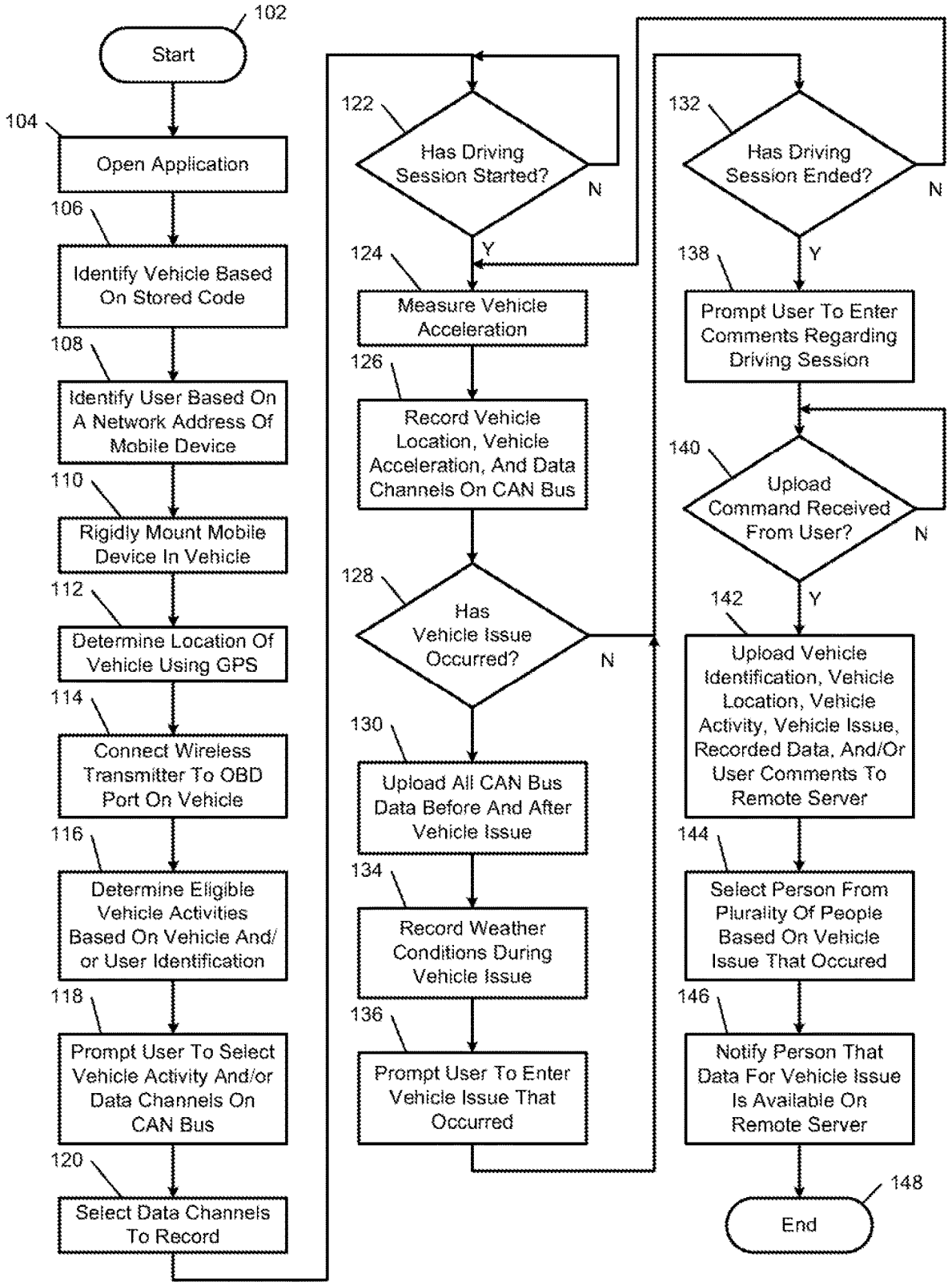
FIG. 2 is a flowchart illustrating an example method for tracking vehicle activity and reporting vehicle issues according to the principles of the present disclosure.

Referring now to FIG. 2, an example method for tracking vehicle activity and reporting vehicle issues begins at 102. The method is described in the context of the modules of FIG. 1. However, the particular modules that perform the steps of the method may be different than the modules mentioned below, or the method may be implemented apart from the modules of FIG. 1.

At 104, the user opens an application on the mobile device 14 for tracking vehicle activity and/or reporting vehicle issues. If the vehicle 12 includes the barcode 35 and the barcode 35 is used to identify the vehicle 12, the user may also use the mobile device 14 to read the barcode 35 on the vehicle 12 at 104. The activity tracking and issue reporting (ATIR) application may include instructions for executing functions performed by one or more (e.g., all) modules of the vehicle 12 and/or one or more (e.g., all) modules of the mobile device 14. The user may instruct the barcode reader 40 to read the barcode 35 by pressing a "read barcode" option on a touchscreen of the user interface device 22 or by issuing a verbal command. As indicated above, the user may use the mobile device 14 to read an RFID tag on the vehicle 12 instead of or in addition to using the mobile device 14 to read the barcode 35.

At 106, the vehicle identification module 42 identifies the vehicle 12 based on, for example, the code stored in the wireless communication module 28. Alternatively, as discussed above, the vehicle identification module 42 may identify the vehicle 12 based on a digital image of the barcode 35. At 108, the user identification module 26 identifies the user. In one example, the UID control module 24 controls the user interface device 22 to prompt a user to log into the ATIR application, and the user identification module 26 identifies the user based on the login information provided. At 110, the user rigidly mounts the mobile device 14 to the vehicle using, for example, the rigid mounting bracket discussed above with reference to FIG. 1.

At 112, the GPS module 36 determines the location of the vehicle 12. At 114, the user connects the wireless connector to the OBD port of the vehicle 12 to allow the mobile device 14 to wirelessly communicate with the vehicle (e.g., to record data from the CAN bus 30). At 116, the UID control module 24 determines which vehicle activities are eligible to be selected by the user based on the vehicle identification and/or the user identification.

At 118, the UID control module 24 controls the user interface device 22 to display a list of the eligible vehicle activities and to prompt the user to select one of the vehicle activities. Additionally or alternatively, the UID control module 24 controls the user interface device 22 to display a list of all of the data channels available on the CAN bus 30 and to prompt the user to select which data channel(s) to record and/or upload. In various implementations, the UID control module 24 may prompt the user to select a vehicle activity and/or to select which data channels to upload when a driving session ends in addition to or instead of prompting the user to make these selections before a driving session begins. At 120, the data recording module 46 selects the data channels to record. In one example, the data recording module 46 selects the data channels to record based on the selected vehicle activity. In another example, the data recording module 46 selects the same data channels to record that the user selected in addition to or instead of selecting the data channels based on the selected vehicle activity. In another example, the data recording module 46 selects the data channels to record based on a default (e.g. predetermined) vehicle activity.

At 122, the data recording module 46 determines whether a driving session has started. In one example, the data recording module 46 determines that a driving session has started when an ignition switch (not shown) of the vehicle 12 is adjusted from an OFF position to an ON or RUN position. When a driving session has started, the method continues at 124. Otherwise, the method continues to determine whether a driving session has started.

At 124, the acceleration module 38 measures the vehicle acceleration. At 126, the data recording module 46 records the vehicle location, the vehicle acceleration, and data channels on the CAN bus 30. The data recording module 46 may record only those data channels that are selected at 118 and/or 120. Alternatively, the data recording module 46 may record all of the data channels available on the CAN bus 30. In various implementations, the acceleration module 38 continuously measures the vehicle acceleration and the data recording module 46 continuously records the vehicle location, the vehicle acceleration, and the CAN bus data while the ATIR application is running.

At 128, the data recording module 46 determines whether a vehicle issue has occurred based on a user input. For example, the data recording module 46 may determine that a vehicle issue has occurred when the user selects a "report vehicle issue" option on a touchscreen of the user interface device 22 or when the user says "report vehicle issue." If a vehicle issue has occurred, the method continues at 130. Otherwise, the method continues at 132.

At 130, the data upload module 48 uploads data recorded for all of the data channels available on the CAN bus 30 during a first period before the user indicates that a vehicle issue occurred and during a second period after the user indicates that a vehicle issue occurred. The data upload module 48 uploads the data to the remote server 16. At 134, the data recording module 46 records the weather conditions at the time when the user indicates that a vehicle issue occurred. The data upload module 48 may also upload the weather conditions to the remote server 16. At 136, the UID control module 24 controls the user interface device 22 to prompt the user to enter the vehicle issue that occurred. In one example, the UID control module 24 controls the user interface device 22 to prompt the user to select the type of vehicle issue that occurred from a dropdown menu (or a verbal list).

At 132, the data recording module 46 determines whether the driving session has ended. In one example, the data recording module 46 determines that a driving session has ended when the ignition switch of the vehicle 12 is adjusted from the ON or RUN position to the OFF position. When the driving session has ended, the method continues at 138. Otherwise, the method returns to 124.

At 138, the UID control module 24 controls the user interface device 22 to prompt the user to enter comments regarding the driving session. The user may enter comments verbally or by typing on a keyboard displayed on the touchscreen. At 140, the data upload module 48 determines whether an upload command has been received from the user. If an upload command has been received, the method continues at 142. Otherwise, the method continues to determine whether an upload command has been received from the user.

At 142, the data upload module 48 uploads to the remote server 16 the user identification, the vehicle identification, the vehicle location throughout the driving session and the corresponding date and time, the selected vehicle activity, any vehicle issue(s) reported during the driving session, the weather conditions during the driving session, CAN bus data recorded during the driving session, and/or the user comments. The data upload module 48 may perform this upload when the user generates the upload command, when a vehicle issue is reported, at the end of the driving session, and/or when the data recording module 46 reaches its memory limit. At 144, the data upload module 48 (or the remote server 16) selects a person (e.g., a development or calibration engineer) from a plurality of people (e.g., a plurality of development and calibration engineers) based on the vehicle issue reported and a predetermined relationship between vehicle issues and the people. For example, if the vehicle issue is a hard transmission shift, the data upload module 48 (or the remote server 16) may select one or more transmission calibration engineers. At 146, the data upload module 48 (or the remote server 16) notifies the selected person that data related to the vehicle issue is available on the remote server 16. The method ends at 148.

In various implementations, the portion of the method of FIG. 2 for tracking vehicle activity and the portion of the method of FIG. 2 for reporting vehicle issues may be independently executed. The vehicle activity tracking portion of the method of FIG. 2 includes steps 102-126, 132, and 138-146. The vehicle issue reporting portion of the method of FIG. 2 includes steps 102-114 and 128, 130, and 134-146. Thus, while vehicle activity tracking portion of the method of FIG. 2 and the vehicle issue reporting portion of the method of FIG. 2 may share some common steps, each of these two portions of the method of FIG. 2 may be executed without executing all of the steps of the method of FIG. 2.

In various implementations, only users for a single company, organization, or department are granted access by an administrator to log into the ATIR application. Once the ATIR application is installed on the mobile device 14, UID control module 24 controls the user interface device 22 to prompt the user to log into the ATIR application using a username and password assigned by the administrator. Depending on the credentials of the user (e.g., title, level, department, etc.), the user is given access to the activity tracking and/or issue reporting features of the ATIR application.

In various implementations, the vehicle 12 and/or the mobile device 14 may communicate with other vehicles and/or mobile devices that have the same or similar functionality as the vehicle 12 and the mobile device 14, respectively. This communication may be accomplished through the cell tower 56. In addition, the UID control module 24 may control the user interface device 22 to display the locations of the other vehicles. Further, the UID control module 24 may control the user interface device 22 to notify the user of the vehicle 12 when one of the other vehicles experiences an issue, the type of vehicle issue experienced, and/or where the vehicle issue was experienced. The user may then drive the vehicle 12 to the same location in an attempt to observe the same issue.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C #, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

None of the elements recited in the claims are intended to be a means-plus-function element within the meaning of 35 U.S.C. § 112(f) unless an element is expressly recited using the phrase "means for," or in the case of a method claim using the phrases "operation for" or "step for."

What is claimed is:

1. A system comprising:

an identification circuit configured to identify a user of a vehicle;

a user interface device (UID) control circuit configured to control a UID to display a list of available vehicle activities based on an identity of the user; and a data recording circuit configured to (i) record data received from a controller area network (CAN) bus of the vehicle during a driving session and (ii) select data channels of the CAN bus to record based on a selected vehicle activity of the available vehicle activities.

2. The system of claim 1, wherein the selected vehicle activity of the available vehicle activities is selected by the user.

3. The system of claim 1, wherein the data recording circuit is configured to record at least one of a location of the vehicle and an acceleration of the vehicle.

4. The system of claim 3, wherein at least one of the location of the vehicle and the acceleration of the vehicle is determined by the UID.

5. The system of claim 3, further comprising a data upload circuit configured to transmit at least one of data received from the CAN bus, the location of the vehicle, and the acceleration of the vehicle to a remote server.

6. The system of claim 5, further comprising a wireless communication circuit operable to transmit data received from the data upload circuit wirelessly to the remote server.

7. The system of claim 1, further comprising a data upload circuit configured to transmit data received from the CAN bus to a remote server.

8. The system of claim 7, further comprising a wireless communication circuit operable to transmit data received from the data upload circuit wirelessly to the remote server.

9. The system of claim 1, wherein the identification circuit is configured to identify the vehicle.

10. The system of claim 1, wherein the identification circuit is configured to identify the user based on input received from at least one of a microchip associated with the user and the UID.

11. A system comprising:

an identification circuit configured to identify a vehicle;

a user interface device (UID) control circuit configured to control a UID to display a list of available vehicle activities based on an identity of the vehicle; and a data recording circuit configured to (i) record data received from a controller area network (CAN) bus of the vehicle during a driving session and (ii) select data channels of the CAN bus to record based on a selected vehicle activity of the available vehicle activities.

12. The system of claim 11, wherein the selected vehicle activity of the available vehicle activities is selected by a user of the vehicle.

13. The system of claim 11, wherein the data recording circuit is configured to record at least one of a location of the vehicle and an acceleration of the vehicle.

14. The system of claim 13, wherein at least one of the location of the vehicle and the acceleration of the vehicle is determined by the UID.

15. The system of claim 13, further comprising a data upload circuit configured to transmit at least one of data received from the CAN bus, the location of the vehicle, and the acceleration of the vehicle to a remote server.

16. The system of claim 15, further comprising a wireless communication circuit operable to transmit data received from the data upload circuit wirelessly to the remote server.

17. The system of claim 11, further comprising a data upload circuit configured to transmit data received from the CAN bus to a remote server.

18. The system of claim 17, further comprising a wireless communication circuit operable to transmit data received from the data upload circuit wirelessly to the remote server.

19. The system of claim 11, wherein the identification circuit is configured to identify a user of the vehicle.

20. The system of claim 19, wherein the identification circuit is configured to identify the user based on input received from at least one of a microchip associated with the user and the UID.

* * * * *